US005625373A

United States Patent [19]

Johnson

[11] Patent Number: 5,625,373

[45] Date of Patent: Apr. 29, 1997

[54] FLAT PANEL CONVERGENCE CIRCUIT

[75] Inventor: Michael J. Johnson, Phoenix, Ariz.

[73] Assignee: Honeywell Inc., Minneapolis, Minn.

[21] Appl. No.: 274,936

[22] Filed: Jul. 14, 1994

[51] Int. Cl.[6] ..... G09G 3/36

[52] U.S. Cl. ..... 345/58; 345/100; 345/101

[58] Field of Search ..... 345/58, 98, 101, 345/60, 61, 62, 63, 78, 94, 99, 100; 348/745; 359/55, 54

[56] References Cited

U.S. PATENT DOCUMENTS

| | | | |
|---|---|---|---|
| 4,633,143 | 12/1986 | McCartney, Jr. | 315/368 |
| 4,757,239 | 7/1988 | Starkey, IV | 348/745 |
| 4,873,516 | 10/1989 | Castleberry | 345/58 |
| 5,029,982 | 7/1991 | Nash | 345/101 |
| 5,041,823 | 8/1991 | Johnson et al. | 340/784 |
| 5,061,920 | 10/1991 | Nelson | 340/784 |
| 5,121,230 | 6/1992 | Honma et al. | 358/75 |
| 5,185,602 | 2/1993 | Bassetti, Jr. et al. | 340/793 |
| 5,204,761 | 4/1993 | Gusmano | 358/461 |
| 5,272,421 | 12/1993 | Kimura et al. | 315/368 |
| 5,434,599 | 7/1995 | Hirai et al. | 345/94 |
| 5,442,370 | 8/1995 | Yamazaki et al. | 345/94 |
| 5,451,978 | 9/1995 | Harju | 345/78 |

FOREIGN PATENT DOCUMENTS

| | | | |
|---|---|---|---|
| 5265405 | 1/1994 | Japan | G09G 3/36 |

*Primary Examiner*—Steven Saras

*Attorney, Agent, or Firm*—Kenneth J. Johnson; John G. Shudy, Jr.

[57] ABSTRACT

A method and apparatus for providing error voltage compensation in a flat panel display. Voltage errors in a column driver for a flat panel display are compensated for by first measuring the voltage level at each column during a known signal level period and comparing it against a known or reference value. This voltage error signal is then stored in an error memory according to column location. During normal operation of the flat panel display, the memory is accessed every time a particular column is scanned. The error voltage is retrieved and added to the raw video signal in order to remove any voltage offset which is introduced in the column driver electronics. This error voltage compensation substance eliminates any streaking which may appear on a display screen.

31 Claims, 6 Drawing Sheets

FLAT PANEL CONVERGENCE CIRCUIT

FIELD OF THE INVENTION

The invention relates to flat panel displays, and more specifically to eliminating streaking and other visual anomalies in flat panel displays.

BACKGROUND OF THE INVENTION

Liquid crystal display (LCD) technology is being developed as a possible successor to cathode ray (CRT) technology for many applications. LCD technology offers important advantages, such as higher reliability and reduced power, size and weight. However, in the current state of development, LCD image rendering capability falls short of that being achievable using CRTs. The present invention addresses a technical obstacle in LCD's which is vertical streaking that appears on display screens, especially when the video signal calls for a black screen.

The cause of the streaking problem can be better understood after a short discussion on the operation of a typical liquid crystal display. As is well known, an LCD is made up of a series liquid crystal cells aligned in rows and columns. Row and column lines run between the liquid crystal cells and carry voltage signals which turn on and off particular cells according to an incoming video signal. The amount a particular picture element turns on is controlled by the voltage level of the column line. For example, 0 volts on the column line may be a completely "off" (black) picture element and 20 V may be a completely "on" picture element. The voltage signals are provided to the column lines by the column driver. The column driver receives the raw video signal as well as various clock and sync pulses, and outputs voltage signals in synchrony with a row driver such that the picture elements are activated in a raster scan format as in a CRT. One element per column (but many columns per row) is activated at a time and the image is continually refreshed.

The driver mechanism in an LCD is typically comprised of a series of interconnected integrated circuits (IC's). Each IC is responsible for transmitting an image signal over a set number of columns. During operation of the display, voltage errors are introduced into the column lines from a variety of sources. Any electronic component within the driver has the potential to add even a minimal voltage to the signal sent out over the column lines. Because a different IC drives a different set of columns, the subtle differences among the IC's can result in different voltage levels being transmitted over the columns.

As an example, assume that there is a linear panel that has a peak gray (white) when driven by a 20 volt signal. With such a display, a just noticeable difference (JND) would appear if the line were driven approximately 0.12 volts lower. This can be derived from human vision models. According to these models, the worst case scenario occurs when displaying black because less intensity change is necessary for a JND. That intensity can correspond to a column line being driven at 0.006 volts higher. Performance requirements predicate that the voltage range be limited to ±3 millivolts over a range of 0–18 volts for graphics. Holding this tolerance can be difficult especially in light of the fact that the standard CMOS op amps used in the drivers typically exhibit ±150 millivolts offset. Drivers using an array of switches and precision voltage sources have become the method of choice, but this becomes clumsy as analog gray scale behavior (or a large number of gray levels) is approached. Therefore, the goal in the design of the electronics for a liquid crystal display is eliminating or significantly reducing the error voltage over the range of operation for the driver.

It is the object of the present invention to provide voltage offset compensation for a liquid crystal display so as to eliminate streaking over the display's full operating range.

SUMMARY OF THE INVENTION

Disclosed herein is an error convergence circuit for a flat panel display. The error convergence circuit is incorporated into a flat panel display which has column drivers which receive a video signal and transmit image signals for individual picture elements in the liquid s crystal matrix over column lines. The convergence circuits include a selective switch which is in electrical contact with the driver so as to receive the image signals which are transmitted over predetermined display columns. Connected to the selective switch is a voltage measurement device which compares the voltage of the image signal with a reference voltage. The voltage difference between the two signals is stored in a memory as an error signal in one-to-one correspondence with the particular driver which outputs the image signal. This error signal is read from the memory, modified, and added into the incoming video signal every time that the particular driver from which the error signal was generated is driven.

In operation, as the different drivers are transmitting an image signal over the columns, the selector switch picks a particular driver and measures a magnitude of the image signal output over a column. This voltage signal is compared to a reference value and if this voltage signal is either greater or less than the reference value an error signal proportional to the difference is stored in a memory. Every time that this particular driver is driven in the future, the memory is accessed and a signal proportional to the error value is added to the video stream so as to compensate for any voltage offset.

The addition of this error signal to the video stream eliminates any streaking which may occur on the display. The error convergence circuit changes the magnitude of the signals into the drivers so that each driver is compensated for any voltage errors which may be introduced into the image signal by the switching elements including op amps, transistors, resistors, capacitors, etc., as well as by any tolerances built up over time and temperature, or part to part variations.

DESCRIPTION OF THE PREFERRED EMBODIMENTS

Figure 1:
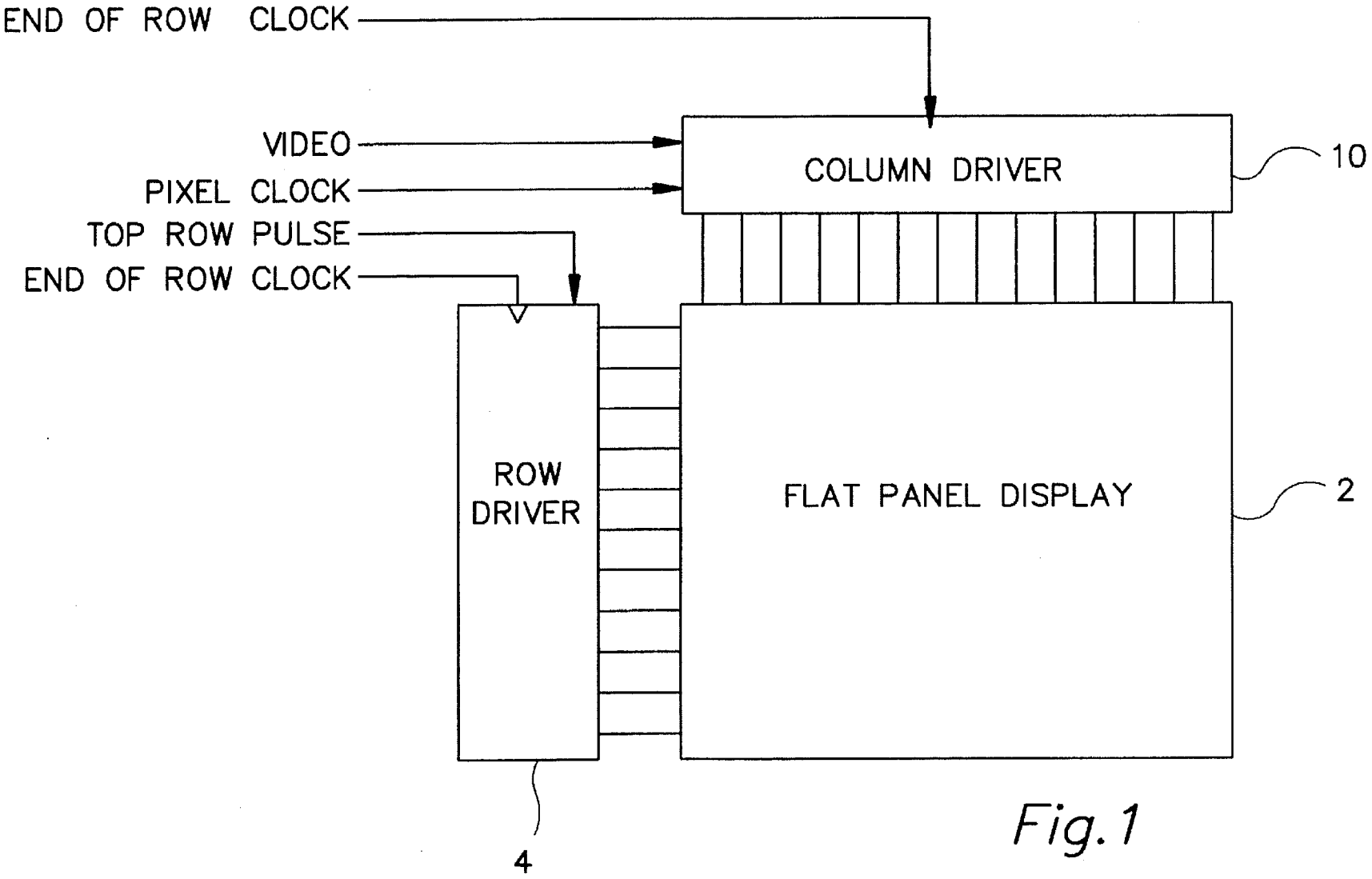
FIG. 1 is a block diagram of a prior art flat panel display system.

Disclosed in FIG. 1 is a simplified block diagram of a prior art flat panel display system. As shown, the flat panel display 2 which is made up of a matrix of liquid crystal cells is connected to both row driver 4 and a column driver 10. Both drivers include multiple IC drivers, each chip provides image signals over a set number of rows and columns. Fed into the drivers are a variety of clock signals such as the pixel clock, the end of row clock 5 and the top row pulse 3. The function of these signals will be described in greater detail below. Also fed into the column driver is video signal 6. The video signal contains the image information which is translated onto the flat panel display 2.

In operation, the video signal comes in over line 6 and is fed into the column driver 10. As the video is fed into the column driver 10 it is clocked into a row long shift register (or a set of shift registers acting in parallel to provide coverage to the entire set of columns on the flat panel). Included in the column driver is a voltage level translator, amplifiers and/or switches, and a row long register file. At the receipt of an end of row pulse, data is transferred from the shift register to the register file and on through the register file to the level translator and the amplifiers, and/or switches. In this way, the individual column driver IC chips transmit the image signals to the individual columns. In synchrony with signals transmitted over the row lines by the row drivers, the column driver IC's activate the individual liquid crystal cells in order to form an image.

A drawback of the prior art flat panel display system is that all types of drivers have a measurable amount of offset evidenced in their outputs. Switches and other components in the driver can add a voltage error to the video signal which is transmitted over the columns. This voltage error creates objectionable visual artifacts which appear as vertical streaks on the screen. These streaks and artifacts are what the present circuit is incorporated into the system to eliminate.

Figure 2:
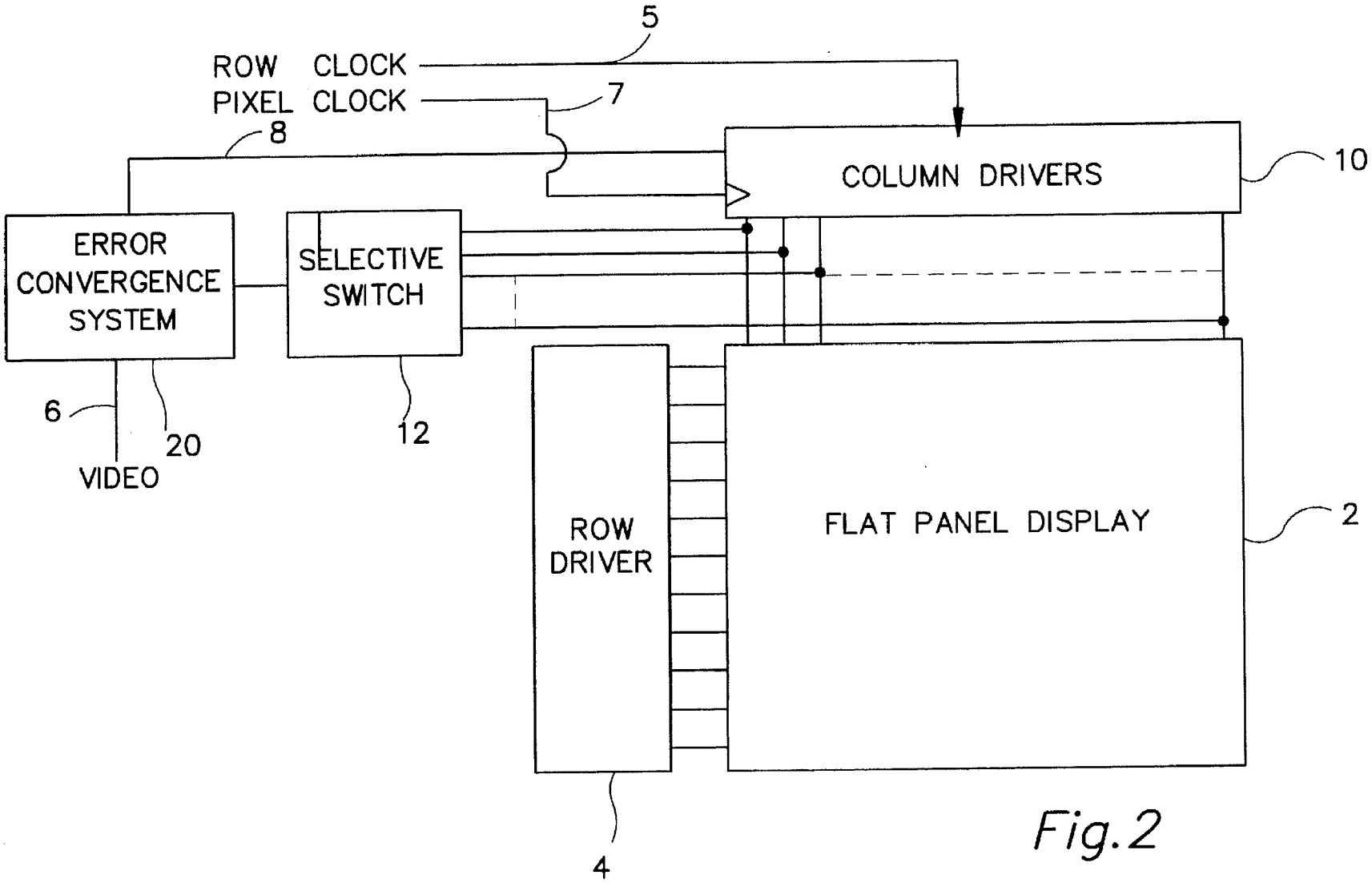
FIG. 2 is a block diagram of the preferred embodiment of the invention incorporating the error convergence circuit.

The present flat panel display with the error convergence circuit is shown in FIG. 2. As with the prior art system column and row drivers provide signals to the flat panel display in order to generate an image. The type of flat panel displays which may be used are of the types which employ column drivers, active matrix and passive matrix types of liquid crystal displays being examples. The row and column drivers each receive timing signals which synchronize the transmission of the signals. Incorporated into the circuit is the error convergence circuit 20 and the selective switch 12. In the particular embodiment shown in FIG. 2, the selective switch is in direct electrical connection with the individual column lines of the flat panel display. This is merely one embodiment, and is not meant to limit the scope of the invention.

The selector switch is in electrical connection with both the column lines and the error convergence circuit and is a multi purpose switch which routes signals transmitted over the column lines. The selector switch switches to a particular column on a rotating basis and directs that signal into the error convergence circuit 20.

Figure 3:
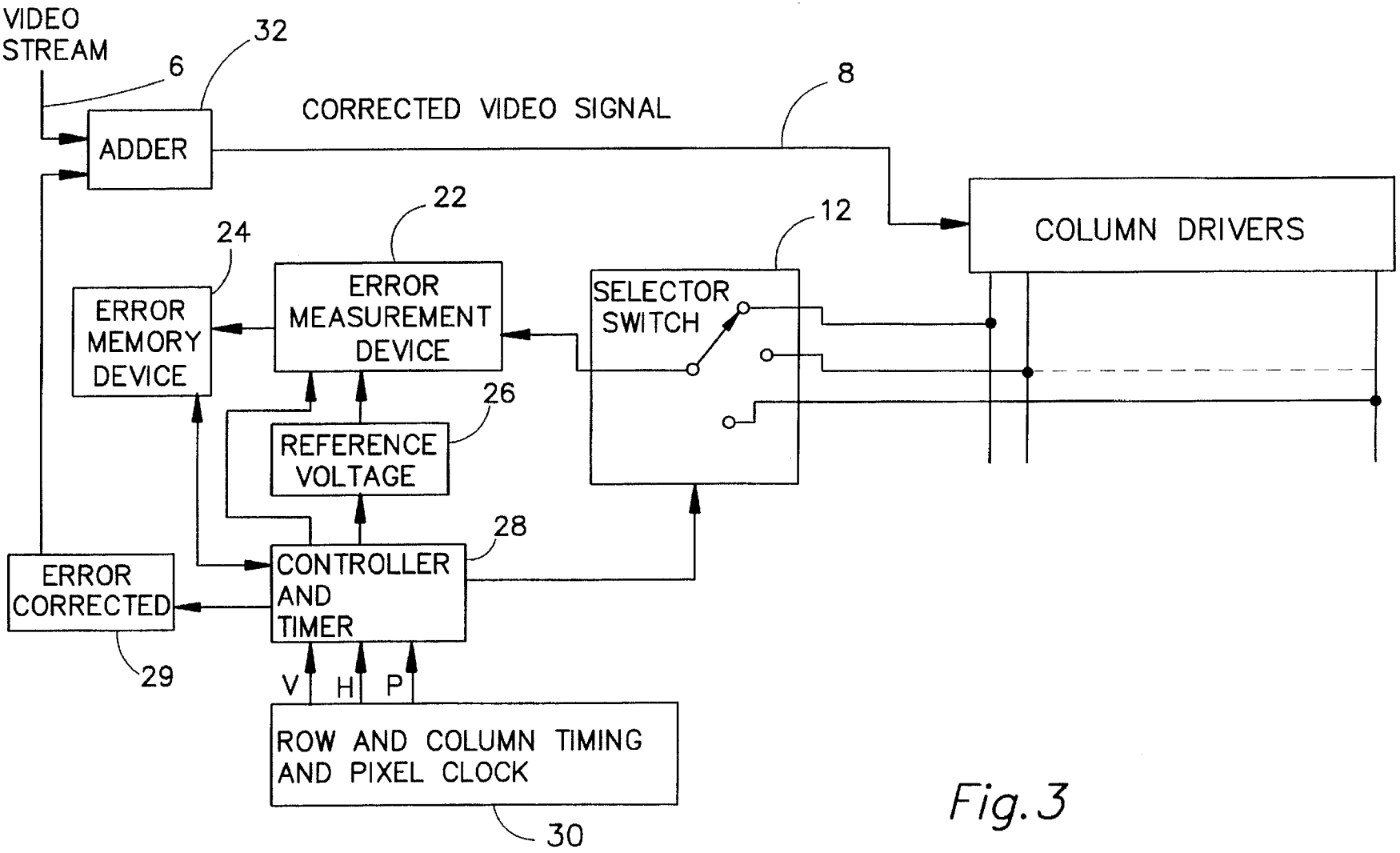
FIG. 3 is a block diagram of the individual components of the error convergence circuit.

The elements which make up the error convergence circuit are shown in detail in FIG. 3. The image signal which passes through the selector switch 12 is transmitted to the error measurement device 22. A control signal from controller 28 determines which column the selector switch makes electrical contact with. Connected to the error measurement device 22 is reference voltage 26. The error measurement device in the preferred embodiment is a comparator and the reference voltage is input into one node of the comparator while the image signal from the columns is input in the other. The signal output from the comparator is an error voltage which is the difference between the column voltage(s) and the reference voltage(s).

Error measurement device 22 is in electrical connection with error memory device 24. This memory device stores the error voltage values for each column of the display or each group of columns. Information input into the memory device is under the direction of controller 28 and is given an address in the memory according to the column or group of columns the error voltage was generated from. Controller 28 is a microcontroller or a microprocessor type of device. The microcontroller may have a scratchpad memory which can be used to implement the error memory function. One function of the controller 28 is to direct the flow of information into and out of the error memory. Implied in this controller is an address generator that provides read and write addresses to the error memory. In the present embodiment where the error signal is read directly from the error memory device 24 by the controller, the error signal is adjusted by a function, for example, a gain factor and routed to the error corrector component 29 for subsequent readout in real time, in synchrony with the raw video stream. The error correction device stores the value needed by the system to eliminate the voltage error. However, if the gain of the system is unity, the error correction device and the error memory may be identical and implemented as the same device. However, it is most likely that the two memories will have a different voltage offset and amplitude range than the signal needed to drive the convergence circuit. The modified error signal read from the error correction device 29 is added to the video stream through adder 32. The adder 32 is implemented as either a digital or analog device. Using an adder is one implementation, though any input into the column driver which can effect error correction is a possible substitute.

Row and column timing block 30 emits standard timing signals or derivatives thereof called row and column timing signals or sync pulses. The row and column timing for the display results from accessing three signals shown as V, H and P. V is the top row pulse which tells the system when the picture bottom has been reached during the scans and it is time to begin at the top of the screen and refresh the image from top to bottom. The H signal is the end of row clock which performs a similar function but horizontally tells the system when the right side of the screen has been reached and it is time to return to the left and start a new row. The P signal, shorthand for pixel clock, designates when counted from the left edge of the screen, where the raw video stream is horizontally. As stated above, its used to determine precisely the column position. The controller uses these signals to determine which column line should be at what voltage at a given moment. If, for example, raw video is routed to the controller, then the controller can determine which voltage should be present on the column for all positions. This is used to either drive the reference signal block or the error corrector block 29.

Figure 4:
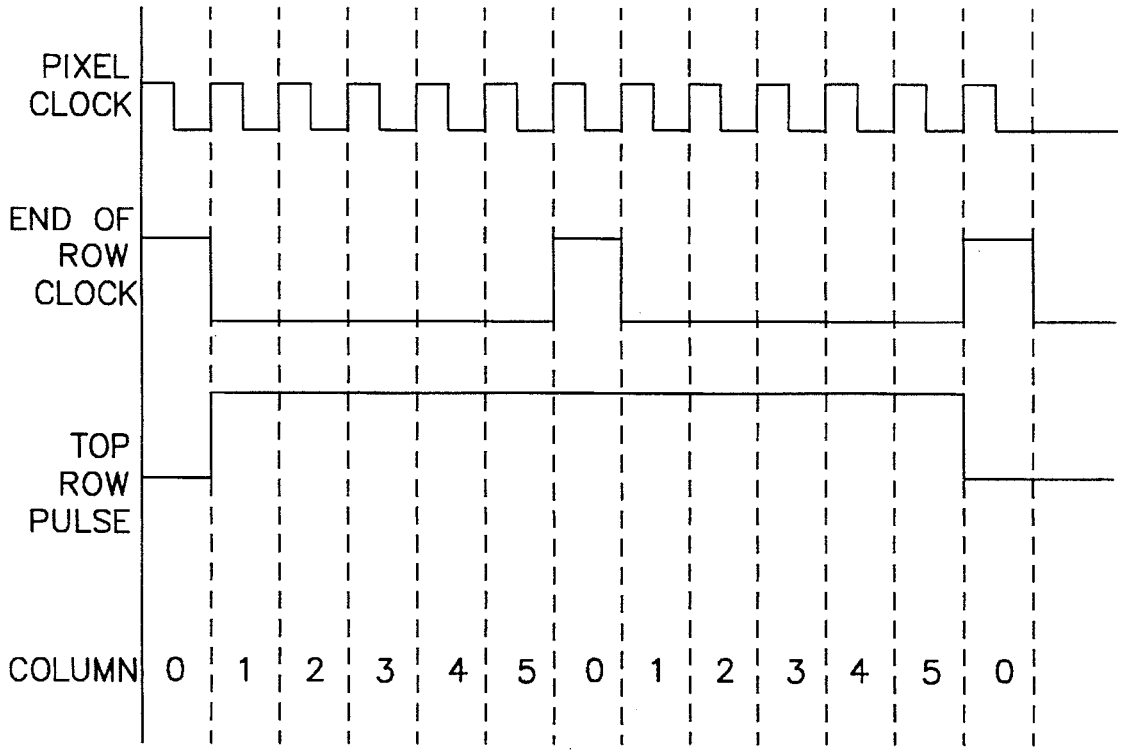
FIG. 4 is a timing diagram of the end of row clock, top of row pulse and pixel clock signals for a 2×5 flat panel display.

To better understand the use of the sync signals, a timing diagram shown in FIG. 4 has been provided which indicates how the particular pixel which is activated is located and identified during operation of the flat panel display. The timing diagram shown is for a flat panel screen which is 5 columns wide and 2 rows deep. As is well known in the art, many flat panel displays have millions of pixels, and the display shown here is merely a simplified example.

In the present system, transitions in the timing or synch pulses indicate that a certain point has been reached in the scanning of the image in the display and that it should be begun again from another point on the screen. The high pulses of the end of row clock reset the row counter so that the count may begin again from the left. Similarly, the top row pulse resets the row counter when the bottom of the screen is reached. Between the combination of the column counter and the row counter, the particular pixel being scanned at a particular time can be identified.

In order to provide the voltage correction, the first step is to generate the error signals for the particular columns. The selector switch is used to switch to a column under test, and the image signal on the column is measured and compared to the expected value. The selector switch must use a switching device technology that when combined with the measurement device exhibits low offset voltages relative to each other. The offset of the switch elements attached to each column group must be less than about 6 millivolts absolute or relative to each other. In the preferred embodiment MOSFET switching devices are used for meeting this requirement. It can be designed to exhibit much less than 6 millivolts offset from input to output. Switches designed and built by Gould are one example of available low offset voltage MOSFET capability.

In the preferred embodiment of the invention, the error signals for the columns are generated during a time period when the video is black. A priori information sets what voltage should correspond to a black image. Reference voltage 26 may be implemented at a constant black video voltage level and the sampling of the column voltages may be done during horizontal and/or vertical sync periods when the video is known to be black, which is typically zero voltage with respect to the back plane voltage applied to the flat panel. If the system is implemented to observe errors during fixed periods when the voltage levels are zero (black video), then transmitting the raw video stream to the controller is not necessary.

In another embodiment of the invention, the error voltage signals can be measured during normal operation of the display using a particular shade of gray. When using shades of gray two approaches are feasible: 1) the test signal is visible to viewer and 2) the test signal is not visible to the viewer.

In the first method, the test gray is allowed to be seen. It may be disruptive to the picture presented unless the gray shade chosen is part of the picture anyway. For a particular gray level, a point is picked on the screen, and in time the gray shade appears and the column drive corresponding to that point and position can be sampled. This is possible when the video stream going to the panel is available to the controller and this portion of the video signal is upstream in time by at least one row time (16 microseconds for a 1024×1204 pixel display, convenient, but not necessary). The controller, if allowed to monitor the incoming video stream can set the switches to select the correct column drive output for measurement and evaluate the measurement result. It has the a priori information to set up the test.

In the second method, the objective is to render the test invisible to the viewer (which may be done effectively using the method above) by using an arbitrarily selected voltage that may or may not be part of the image displayed on the screen. In this case the voltage level can be rendered on the screen for just one row or frame time (typically 16 microseconds or 16 milliseconds, respectively) or some equivalently short period to keep it from being visually obtrusive. Another way is to apply a known voltage during a vertical blank. The row signals may be held to select no rows while the test voltage is applied. This is known as the deselect mode. For many types of displays the row deselecting voltage is negative, −15 volts for active matrices, or a $\pm V_{cutoff}$ or approximately ±1.5 volts for passive matrices. $V_{cutoff}$ is the voltage which supplies insufficient energy to activate the liquid crystal from its resting state.

During blanking periods, black is applied or the last voltage displayed is left. This method asserts a to-be-measured target voltage instead, and keeps it from being visible by pulling away the active drive level on the row. Modern row drivers can be altered to allow this to happen or in the preferred solution can be driven in such a manner as to allow standard drivers to be used as they are. This implies the control signals available today are used to deselect the row driver from being in the activation state, a positive voltage like 10 volts for active matrices and $\pm V_{on}$ for passive matrices.

Convenient control signals to use for this purpose are the clock signal and the data in signal. The clock signal shifts a galloping one (on-state logic level) from the data-in signal through the row driver (which is a shift register followed by a level translator to get to the voltage range for the panel and an amplifier/switch which drives the panel and is connected to the row lines). By walking a 1 through the shift register from top to bottom the clock and shift register activate each row or pair of rows successively in the panel. The data-in signal is set to a one for one row time at the top of the screen, and lowered to zero till the scan returns to the top of the screen.

Regardless of the method used to generate the error signals, these signals resulting from the comparisons are stored in the memory and a priori information is used to set the correction function which is a function of the error signal as well as the AC and DC electro-optic gains of the system. These gains are a function of temperature, image coherence, timing, aging, liquid crystal material, polarizer settings and driver offset. The controller makes these changes and stores the modified error signals in the error corrector. When a particular column or driver is driven during operation of the display, the controller retrieves the modified error signal for that column or driver and it is combined with the raw video stream through the adder, or other suitable pathway (typically the voltage reference supplies a selector type of driver).

The operation of the present system can be better understood by the following example. During the initial stage of operation of the flat panel display, the video signal is black meaning that the voltage measured at the column should be 0 volts. But, for example, if column N is at 60 millivolts and the selector switch has an offset of 4 millivolts, the measuring device will measure 64 millivolts for column N. At this point, the memory device stores 64 millivolts for column N as an error voltage in the error memory. The controller then measures the next column either during the current vertical synch period or over many periods and stores away a complete list of error voltages for all columns or column groups.

The controller applies appropriate gain functions to the error values. For example, if the raw video is 2 volts per pixel and the column driver amplifies that by a factor of ±5 so the output is ±10 volts. The polarity is a function of odd/even frame drive to prevent electroplating in the liquid crystal. The controller via a priori information senses that this is an even frame and that the system gain and the polarity is positive. So the gain for this even column is ±5, the error that should go to the adder is −64/5 millivolts. The error corrector 29 receives a −64/5 value and it is stored in a storage cell for column N. During operation of the display, the error corrector table 7 is readout in synchrony with the raw video stream. The error for column N is read directly into the adder where the adjustment is made. The adder feeds in a voltage to the column driver that is −64/5 plus the raw video signal. The specific timing elements and implementation are subject to optimization criteria (cost, power, size, level of integration . . . ) of each system.

Figure 5:
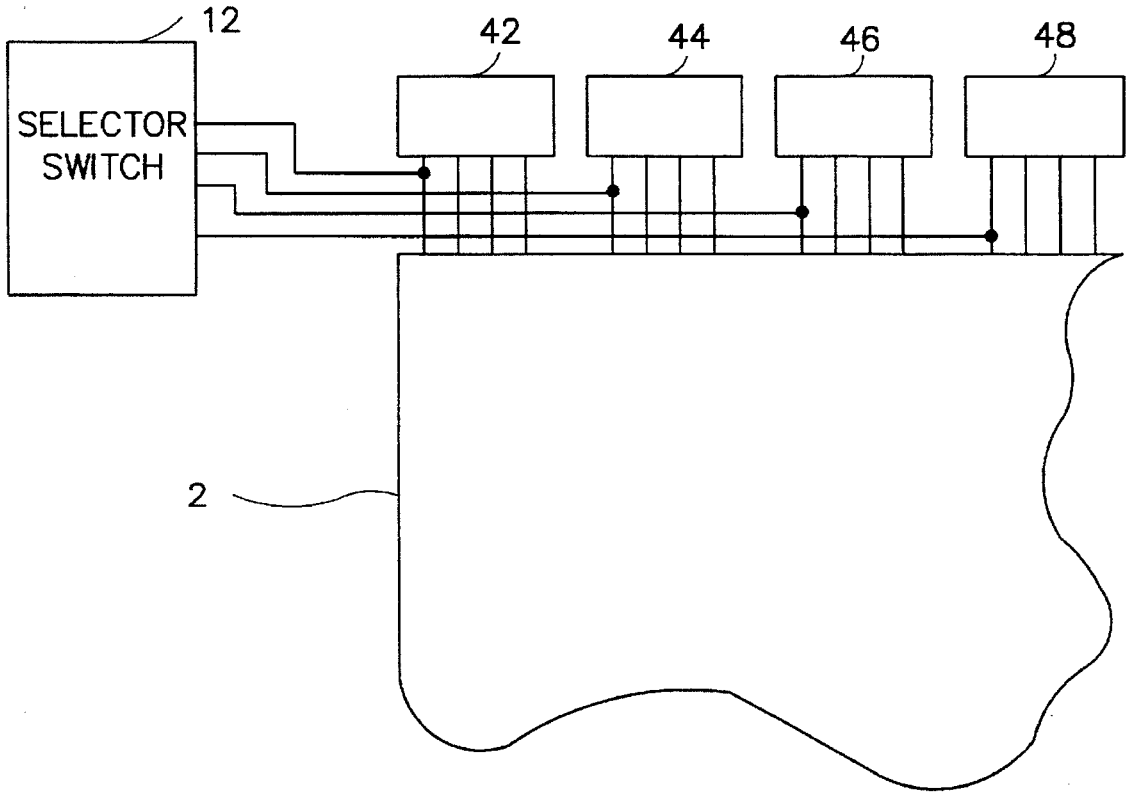
FIG. 5 is a diagram of the first embodiment of the invention showing in particular the electrical connection between one column per driver set and the selector switch.

A detailed view of the interaction between the selector switch 12 and the column driver is shown in FIG. 5. As is well known in the art, column drivers are comprised of a series of driver ICs (though integrating drivers onto panels is an emerging technology). The driver ICs 42–48 provide the image signals over a predetermined number of columns in the flat panel display 2. Each driver IC is then connected to the other operating electronics within the column driver. In the first embodiment of the invention, the selector switch is in electrical connection with only one driver from each driver IC. This setup offers the advantage that the columns that come from each driver IC experience nearly identical offset due to switching elements within the individual driver ICs. By measuring the voltage offset on just one column per IC it provides an accurate representation of the voltage errors on the other columns within the IC. This design is simple because it does not require that a line run from every column to selector switch 12.

Figure 6:
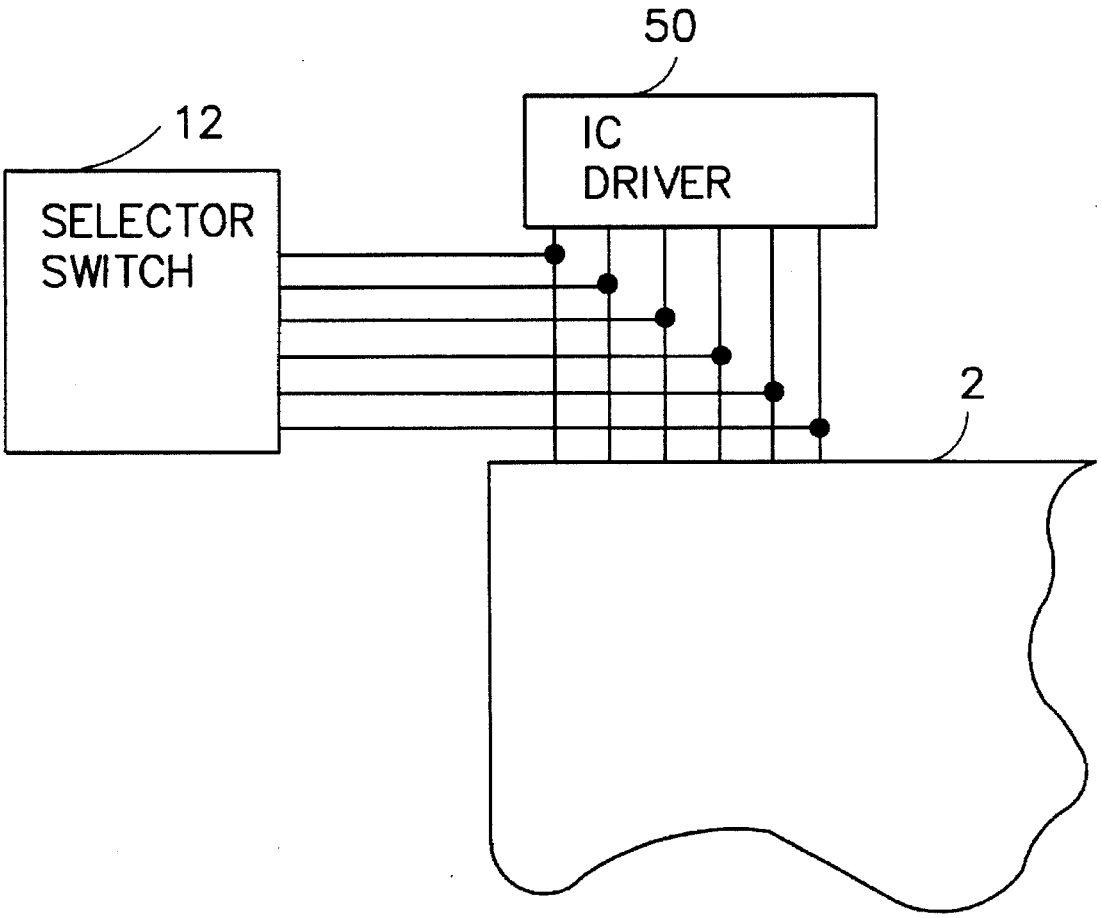
FIG. 6 is a diagram of the second embodiment of the invention showing in particular the electrical connection between each column of a driver and the selector switch.

The second embodiment of the invention is shown in FIG. 6. In this particular case, error measurement lines run from every column on a particular IC (or driver array on an integrated driver). This allows for precise error voltage control in applications where this kind of compensation is required. The selector switch is adapted to handle the multiple inputs from each column of each driver IC.

The foregoing is a description of a novel and nonobvious error convergence circuit. The applicant does not intend to limit the invention through the foregoing description, but instead define the invention through the claims appended hereto.

I claim:

1. A convergence circuit for providing voltage error compensation in a flat panel display, where the flat panel display has a plurality of column driving means which receive a video signal column driver input and provide image signals to pixel columns of the flat panel display comprising:

means to receive the image signals from each of said driving means and to compare the magnitude of the image signals against a reference signal of a known magnitude;

first memory means to store error signals which are proportionate to the difference between the image signals output by said driving means and said reference signal, said error signals for all pixel columns or pixel column groups are stored in said memory according to an address which corresponds to the driving means from which the error signal was generated; and means to retrieve the error signals from said memory means which corresponds to the driving means currently being driven by the video signal, modify said error signal, and combine the modified error signal with the video signal column driver input to provide voltage error compensation for the column being driven by one of said driving means.

2. The convergence circuit for providing error compensation in a flat panel display of claim 1 wherein the image signals are read from the columns by a selector switch which provides an electrical connection to the driving means being driven.

3. The convergence circuit for providing error compensation in a flat panel display of claim 2 wherein the reference signal is provided by a reference voltage source, the reference voltage source is compared against the magnitude of the image signal by a comparator which is in electrical connection with the selector switch, said comparator outputs the error signal to said memory means.

4. The convergence circuit for providing error compensation in a flat panel display of claim 3 further comprising an adder which adds the modified error signal to the video signal column driver input.

5. The convergence circuit for providing error compensation in a flat panel display of claim 4 wherein a microcontroller or microprocessor controls the selector switch, assigns addresses to the error signals stored, generates the modified error signals which are proportional to the error signals, and provides the modified error signal to adder in synchrony with the video signal column driver input and the driving means currently being driven.

6. The convergence circuit for providing error compensation in a flat panel display of claim 5 wherein a second memory means in electrical contact with said microcontroller or microprocessor stores the modified error signal and outputs the modified error signals in synchrony with the video signal column driver input.

7. The convergence circuit for providing error compensation in a flat panel display of claim 6 wherein the reference voltage source is at zero volts and the video signal column driver input is at a corresponding level when the error signals are generated and stored in the first storage means.

8. The convergence circuit for providing error compensation in a flat panel display of claim 6 wherein the microcontroller or microprocessor varies the reference voltage source magnitude according to the magnitude of the video signal column driver input.

9. The convergence circuit for providing error compensation in a flat panel display of claim 2 wherein the selector switch is connected to every one of the columns of the liquid crystal display.

10. The convergence circuit for providing error compensation in a flat panel display of claim 2 wherein the selective switching means is connected to one column per each of said driving means.

11. The convergence circuit for providing error compensation in a flat panel display of claim 1 wherein the flat panel display is of the active matrix type.

12. The convergence circuit for providing error compensation in a flat panel display of claim 1 wherein the flat panel display is of the passive matrix type.

13. A method of reducing error signals in a flat panel display, where the flat panel display has a plurality of column driving means which receive a video signal column driver input and provide image signals to pixel columns of the flat panel display, comprising the steps of:

identifying a number of the pixel columns of the flat panel display to monitor;

measuring the signal intensity on each of the identified pixel columns while the column is being driven;

comparing the magnitude of the signal on the identified column being driven to a reference signal and generating an error signal which is the difference between the signal on the column being driven and the reference signal;

storing the error signal for every pixel column or pixel column group in a first memory with an address associated with the column being driven; and during operation of the flat panel display, retrieving the error signal from the memory, modifying the error signal, and adding the modified error signal to the video signal column driving input while the particular column associated with the error signal is being driven.

14. The method of reducing error signals in a flat panel display of claim 13 wherein the modified error signal is stored in a second memory with a second address corresponding to the column being driven, the modified signal is retrieved from the second memory and added in synchrony to the video signal column driver input.

15. The method of reducing error signals in a flat panel display of claim 13 wherein the error signals are generated during a predetermined test period when the flat panel display is not in operation and the video signal column driver input is of a known value.

16. The method of reducing error signals in a flat panel display of claim 15 wherein the reference signal is at zero volts when the video signal column driver input is at a corresponding level during the predetermined test period.

17. The method of reducing error signals in a flat panel display of claim 13 wherein the error signals are generated during operation of the flat panel display and the column signals used in generating the error signals are incorporated in an image generated on the flat panel display.

18. The method of reducing error signals in a flat panel display of claim 17 wherein the reference signal corresponds with the magnitude of the signal on the identified column.

19. The method of reducing error signals in a flat panel display of claim 13 wherein one of the pixel columns of each of the driving means is identified for monitoring.

20. The method of reducing error signals in a flat panel display of claim 13 wherein each of the columns of each of the driving means is identified for monitoring.

21. The method of reducing error signals in a flat panel display of claim 13 wherein the error signals are generated over short periods of time during operation of the flat panel display so as to not be visually obtrusive upon an image generated on the flat panel display.

22. A convergence circuit for providing voltage error compensation in a flat panel display, where the flat panel display has a plurality of column driving means which receive a video signal column driver input and provide image signals to pixel columns of the flat panel display comprising:

means to receive the image signals from each of said driving means and to compare the magnitude of the image signals against a reference signal of a known magnitude;

first memory means to store error signals which are proportionate to the difference between the image signals output by said driving means and said reference signal, said error signals are stored in said memory according to an address which corresponds to the driving means from which the error signal was generated;

means to retrieve the error signals from said memory means which corresponds to the driving means currently being driven by the video signal, modify said error signal, and combine the modified error signal with the video signal column driver input to provide voltage error compensation for the column being driven by one of said driving means; and an adder which adds the modified error signal to the video signal column driver input; and wherein:

the image signals are read from the columns by a selector switch which provides an electrical connection to the driving means being driven;

the reference signal is provided by a reference voltage source, the reference voltage source is compared against the magnitude of the image signal by a comparator which is in electrical connection with the selector switch, said comparator outputs the error signal to said memory means; and a microcontroller or microprocessor controls the selector switch, assigns addresses to the error signals stored, generates the modified error signals which are proportional to the error signals, and provides the modified error signal to adder in synchrony with the video signal column driver input and the driving means currently being driven.

23. The convergence circuit for providing error compensation in a flat panel display of claim 22 wherein a second memory means in electrical contact with said microcontroller or microprocessor stores the modified error signal and outputs the modified error signals in synchrony with the video signal column driver input.

24. The convergence circuit for providing error compensation in a flat panel display of claim 23 wherein the reference voltage source is at zero volts and the video signal column driver input is at a corresponding level when the error signals are generated and stored in the first storage means.

25. The convergence circuit for providing error compensation in a flat panel display of claim 23 wherein the microcontroller or microprocessor varies the reference voltage source magnitude according to the magnitude of the video signal column driver input.

26. A convergence circuit for providing voltage error compensation in a flat panel display, where the flat panel display has a plurality of column driving means which receive a video signal column driver input and provide image signals to pixel columns of the flat panel display comprising:

means to receive the image signals from each of said driving means and to compare the magnitude of the image signals against a reference signal of a known magnitude;

first memory means to store error signals which are proportionate to the difference between the image signals output by said driving means and said reference signal, said error signals are stored in said memory according to an address which corresponds to the driving means from which the error signal was generated; and means to retrieve the error signals from said memory means which corresponds to the driving means currently being driven by the video signal, modify said error signal, and combine the modified error signal with the video signal column driver input to provide voltage error compensation for the column being driven by one of said driving means; and wherein:

the image signals are read from the columns by a selector switch which provides an electrical connection to the driving means being driven; and the selective switching means is connected to one column per each of said driving means.

27. A method of reducing error signals in a flat panel display, where the flat panel display has a plurality of column driving means which receive a video signal column driver input and provide image signals to pixel columns of the flat panel display, comprising the steps of:

identifying a number of the pixel columns of the flat panel display to monitor;

measuring the signal intensity on each of the identified pixel columns while the column is being driven;

comparing the magnitude of the signal on the identified column being driven to a reference signal and generating an error signal which is the difference between the signal on the column being driven and the reference signal;

storing the error signal in a first memory with an address associated with the column being driven; and during operation of the flat panel display, retrieving the error signal from the memory, modifying the error signal, and adding the modified error signal to the video signal column driving input while the particular column associated with the error signal is being driven; and wherein the error signals are generated during a predetermined test period when the flat panel display is not in operation and the video signal column driver input is of a known value.

28. The method of reducing error signals in a flat panel display of claim 27 wherein the reference signal is at zero volts when the video signal column driver input is at a corresponding level during the predetermined test period.

29. A method of reducing error signals in a flat panel display, where the flat panel display has a plurality of column driving means which receive a video signal column driver input and provide image signals to pixel columns of the flat panel display, comprising the steps of:

identifying a number of the pixel columns of the flat panel display to monitor;

measuring the signal intensity on each of the identified pixel columns while the column is being driven;

comparing the magnitude of the signal on the identified column being driven to a reference signal and generating an error signal which is the difference between the signal on the column being driven and the reference signal;

storing the error signal in a first memory with an address associated with the column being driven; and during operation of the flat panel display, retrieving the error signal from the memory, modifying the error signal, and adding the modified error signal to the video signal column driving input while the particular column associated with the error signal is being driven; and wherein:

the error signals are generated during operation of the flat panel display and the column signals used in generating the error signals are incorporated in an image generated on the flat panel display; and the reference signal corresponds with the magnitude of the signal on the identified column.

30. A method of reducing error signals in a flat panel display, where the flat panel display has a plurality of column driving means which receive a video signal column driver input and provide image signals to pixel columns of the flat panel display, comprising the steps of:

identifying a number of the pixel columns of the flat panel display to monitor;

measuring the signal intensity on each of the identified pixel columns while the column is being driven;

comparing the magnitude of the signal on the identified column being driven to a reference signal and generating an error signal which is the difference between the signal on the column being driven and the reference signal;

storing the error signal in a first memory with an address associated with the column being driven; and during operation of the flat panel display, retrieving the error signal from the memory, modifying the error signal, and adding the modified error signal to the video signal column driving input while the particular column associated with the error signal is being driven; and wherein one of the pixel columns of each of the driving means is identified for monitoring.

31. A method of reducing error signals in a flat panel display, where the flat panel display has a plurality of column driving means which receive a video signal column driver input and provide image signals to pixel columns of the flat panel display, comprising the steps of:

identifying a number of the pixel columns of the flat panel display to monitor;

measuring the signal intensity on each of the identified pixel columns while the column is being driven;

comparing the magnitude of the signal on the identified column being driven to a reference signal and generating an error signal which is the difference between the signal on the column being driven and the reference signal;

storing the error signal in a first memory with an address associated with the column being driven; and during operation of the flat panel display, retrieving the error signal from the memory, modifying the error signal, and adding the modified error signal to the video signal column driving input while the particular column associated with the error signal is being driven; and wherein each of the columns of each of the driving means is identified for monitoring.

* * * * *